US005524814A

United States Patent [19]

Davis

[11] Patent Number: 5,524,814

[45] Date of Patent: Jun. 11, 1996

[54] COLLAPSIBLE CONTAINER FOR CARRY-OUT FOODS

[76] Inventor: Lee Davis, 2531 Sawtelle Blvd. #3, Los Angeles, Calif. 90064

[21] Appl. No.: 344,481

[22] Filed: Nov. 7, 1994

[51] Int. Cl.[6] ..... B65D 71/52; B65D 5/36

[52] U.S. Cl. ..... 229/117.08; 220/738; 224/906; 229/117.26; 229/120.15; 229/120.22; 229/904

[58] Field of Search ..... 229/117.07, 117.08, 229/117.25, 117.26, 120.15, 120.22, 904, 400; 206/565; 220/737, 738; 224/270, 906

[56] References Cited

U.S. PATENT DOCUMENTS

| | | | |
|---|---|---|---|
| 381,134 | 4/1888 | Hicks | 229/117.26 |
| 2,586,301 | 2/1952 | Castle | 229/120.22 |
| 2,794,585 | 6/1957 | Wagner | 229/904 |
| 2,833,458 | 5/1958 | Toensmeier | 229/904 |
| 3,013,710 | 12/1961 | Kronson et al. | 229/120.15 |
| 3,189,247 | 6/1965 | Wischusen | 229/904 |
| 4,757,937 | 7/1988 | Maio et al. | 229/904 |
| 4,837,865 | 6/1989 | Roth | 229/904 |
| 4,946,094 | 8/1990 | Stang | 224/220 |
| 4,981,217 | 1/1991 | Lim | 229/904 |
| 5,348,218 | 9/1994 | Haire et al. | 229/904 |

FOREIGN PATENT DOCUMENTS

| | | | |
|---|---|---|---|
| 592713 | 2/1960 | Canada | 229/117.26 |

*Primary Examiner*—Gary E. Elkins
*Attorney, Agent, or Firm*—Erik M. Arnhem

[57] ABSTRACT

A box, or carton, for carry-out restaurant foods, includes a collapsible box body formed out of cardboard. Upper and lower straps are anchored to the box side walls and the box end walls to span the box corners. These straps can be pulled away from the box walls to form loops for retaining or stabilizing beverage containers located in corner areas of the box. The straps engage the cups near the upper and lower edges of the cups, so that the cup is effectively restrained against tipping or sliding. The box is provided with a cardboard carrying handle that can be folded into the box when it is desired to fold the box walls into a flat package suitable for storage or shipment.

2 Claims, 4 Drawing Sheets

COLLAPSIBLE CONTAINER FOR CARRY-OUT FOODS

BACKGROUND OF THE INVENTION

1. Field of the Invention

This invention relates to a collapsible box designed for use in fast food restaurants for containing carry-out foods, e.g. sandwiches, coffee and soft drinks.

2. Prior Development

Collapsible cardboard boxes are often used for containing foods that are to be taken out of a restaurant to an automobile or residence for consumption. In many cases the boxes are stored in a flat condition in order to permit a maximum number of boxes to be stored in a given storage space. As each box becomes needed, the box structure is unfolded to a three dimensional configuration, suitable for holding sandwiches and other food items.

Coffee, soft drinks and soups are often dispensed into disposable cups that can be placed in the aforementioned carry-out food containers. Each cup is restrained against tipping, sliding in the box (container) by means of a strap that extends diagonally across a corner of the box, whereby the strap partially encircles the cup.

One problem with conventional collapsible boxes for fast food items, is that the heighth of the box is insufficient to effectively restrain the beverage cups against tipping as might permit liquid to overflow the cup. Conventional collapsible boxes rely on a single strap in each box corner to stabilize and restrain each cup. It has been found that the single strap is located too close the box bottom wall to prevent the associated cup from tipping or spilling, when the box is tilted or moved rapidly.

Another problem with conventional collapsible boxes is that such boxes are usually not equipped with carrying handles. The lack of a carrying handle means that the person has to use two hands for carrying the box. If the person attempts to carry the box with one hand, the box may slip out of the person's hand, or bend, or tilt to such an extent that the sandwiches and beverages fall out of the box.

SUMMARY OF THE PRESENT INVENTION

The present invention relates to a collapsible box usable for holding carry-out foods and beverages, without danger that the beverage cups will spill or overturn. The box is designed as a relatively deep construction, typically measuring about six inches deep, whereby the upper edges of the box side walls are relatively close to the upper edges of the beverage cups placed in the box.

Each corner of the box is provided with an upper strap and a lower strap, said straps extending diagonally across the corner to straddle a beverage cup placed in the box corner. The beverage cup is restrained against shifting or tilting by the box side walls that form the box corner, and by the upper and lower straps that partially encircle the cup. The vertically spaced straps engage the beverage cup near the upper and lower edges of the cup, such that the cup is effectively restrained and stabilized against shifting or tilting.

The improved box is provided with a carrying handle that has an inverted U-configuration. The handle includes a web portion overlying the box, and two arm portions extending downwardly from the web portion to connect with the sides of the box. A person can grasp the handle with one hand to lift and transport the box.

The U-shaped handle and box are designed to be readily collapsed into a flat condition for storage purposes. The handle and box are preferably formed of cardboard, with crease lines at selected points, whereby the sides of the box can be folded downwardly into the box bottom wall, to form a flattened box structure. The U-shaped handle is foldable so that the web portion of the handle extends along the box bottom wall, and the arm portions of the handle extend along the box side walls. The folded handle nests within the folded box, so that when the box is unfolded to its operating three dimensional configuration the handle can be pulled upwardly out of the box to its operating condition.

The invention is concerned with a foldable box construction, preferably formed out of cardboard, and having a foldable U-shaped handle that can be used for lifting and carrying the box. Each corner of the box is equipped with upper and lower straps adapted to straddle and encircle a beverage cup placed in the box corner. The straps are foldable, or retractible, to assume positions generally coplanar with the box side walls, under certain conditions, e.g. when no beverage cup is to be placed in the box, or when the box is in the flat folded condition.

Further features, objects and advantages of the invention will be apparent from the drawings and the description of the preferred embodiments of the invention.

THE DRAWINGS

FIG. 6 is taken on line 6—6 in FIG. 2.

DESCRIPTION OF A PREFERRED EMBODIMENT OF THE INVENTION

Figure 1:
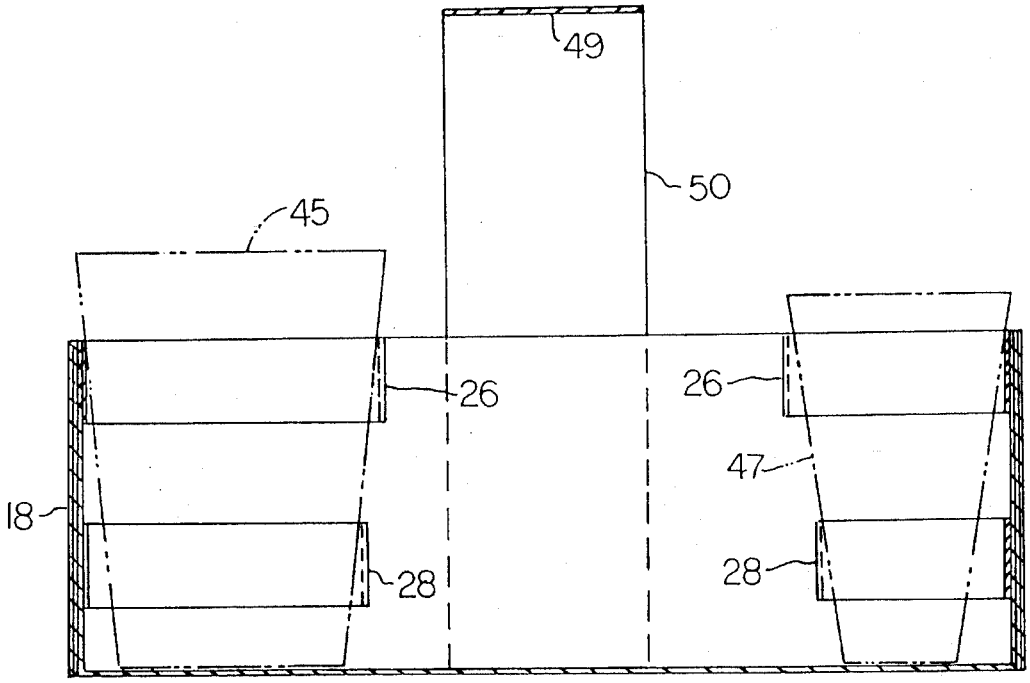
FIG. 1 is a sectional view of a preferred embodiment of the invention, taken on line 1—1 in FIG. 2.
Figure 2:
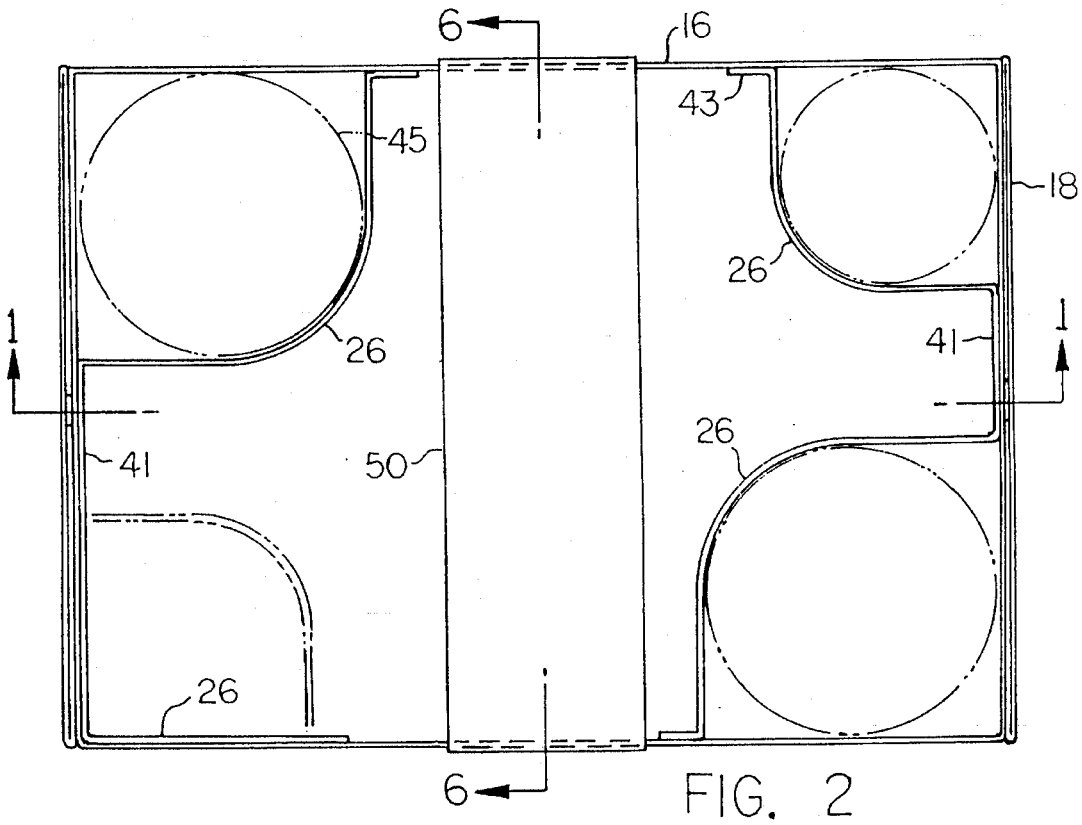
FIG. 2 is a top plan view of the FIG. 1 embodiment.
Figure 6:
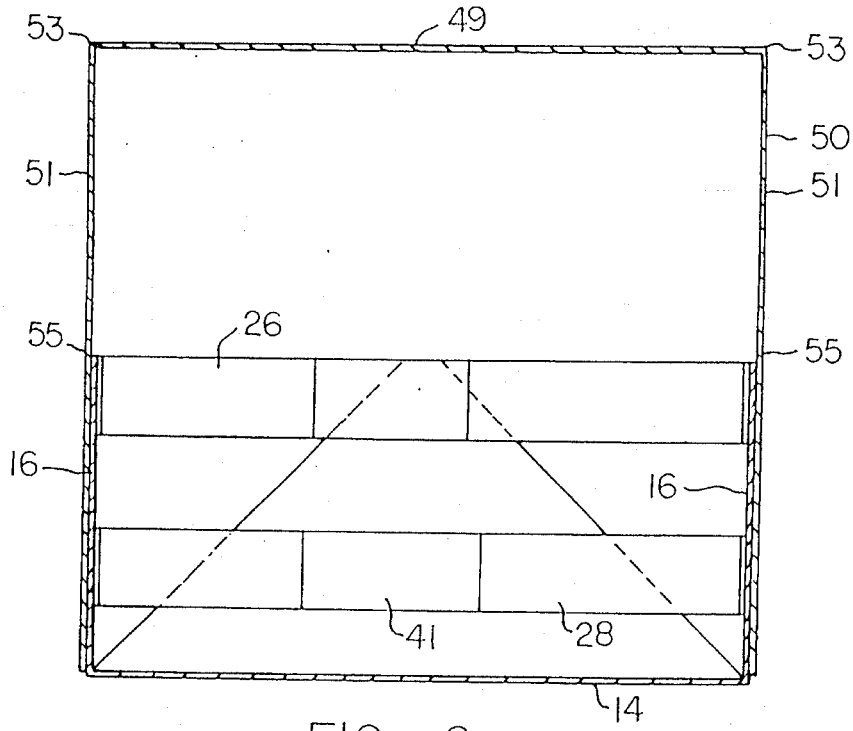
FIG. 6 is a transverse sectional view taken through the assembled box of FIGS. 1 and 2.

The drawings show three forms that the invention can take. FIGS. 1, 2 and 6 show one form of the invention; FIG.

7 fragmentarily shows a second embodiment of the invention. A third form of the invention is shown in FIGS. 10 through 13.

The embodiment of the invention depicted in FIGS. 10 through 13 is the simplest and least complicated of the three illustrated embodiments.

For purposes of best explaining the invention, the embodiment of FIGS. 10 through 13 will be described first.

Figure 10:
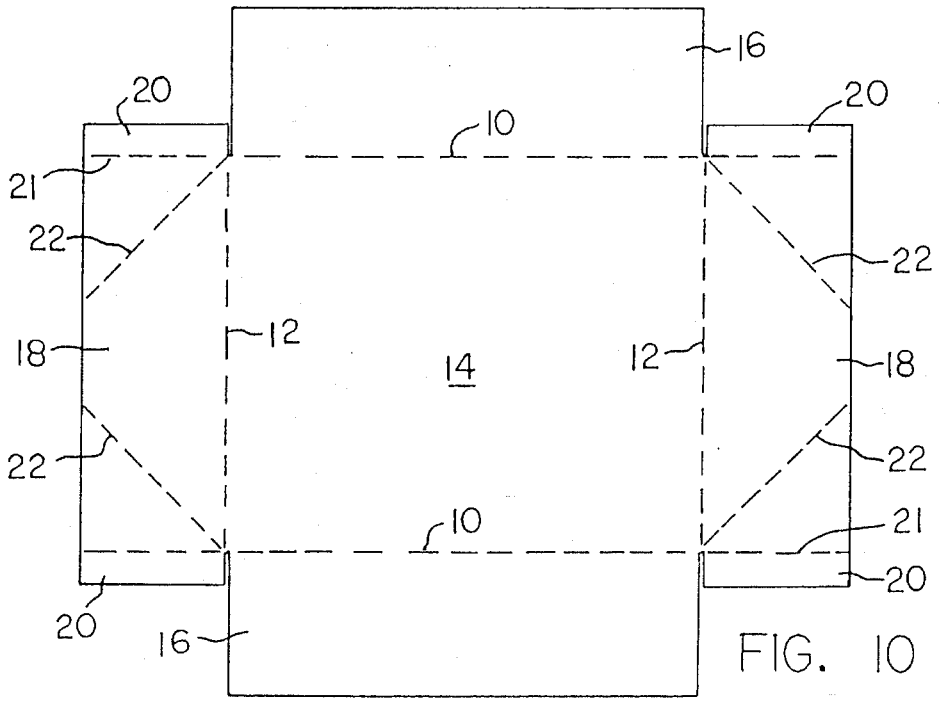
FIG. 10 is a view taken in the same direction as FIG. 3, but showing a different cardboard blank structure that can be used in practice of the invention.

FIG. 10 shows a cardboard blank used to form a carry-out food container box, according to the invention. The cardboard blank has two longitudinal crease lines 10 and two transverse crease lines 12 that collectively circumscribe (or define) a box bottom wall 14. Two longitudinal box side walls are designated by numeral 16; two box end walls are designated by numeral 18. Each end wall 18 has crease lines 21 defining two laterally extending tabs 20 that are used to join the end walls to side walls 16. Also, each end wall 18 has two diagonal crease lines 22, that enable the box to be folded into a flat configuration for compact storage (one flat structure stacked on another in a designated storage area).

Figure 9:
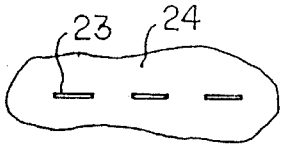
FIG. 9 is a fragmentary view showing a slit arrangement that can be used to form crease lines in the cardboard blanks depicted in FIGS. 3 and 10.

The various crease lines 10, 12, 21 and 22 are preferably formed by slits cut through the cardboard. As shown in FIG. 9, slits 23 are cut through the cardboard material 24 to form an imaginary crease line. Typically, each slit 23 can have a length of about one quarter inch; the slit spacing can be about one quarter inch, such that the cardboard is sufficiently weakened along the defined crease line to enable the cardboard material to be bent or folded in a direction normal to the crease line.

Figure 11:
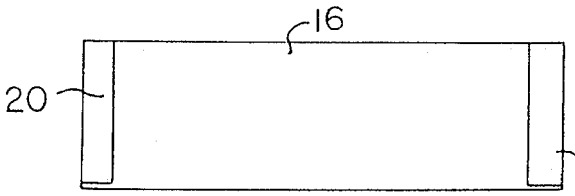
FIG. 11 is a side elevational view of a cardboard box formed from the FIG. 10 cardboard blank.

Referring to FIGS. 10 and 11,, the box is formed into a three dimensional configuration by bending walls 16 and 18 upwardly around crease lines 10 and 12, such that walls 16 and 18 are normal to bottom wall 14. Tabs 20 are then bent on crease lines 21, and glued to the outer surfaces of walls 16, thereby giving the box the operating three dimensional configuration depicted in FIG. 11.

Figure 12:
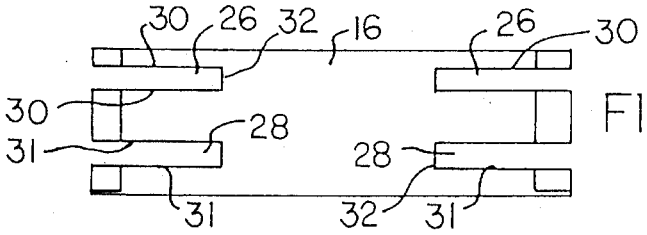
FIG. 12 is a view taken in the same direction as FIG. 11, but after corner areas of the box have been cut to form the cup-holding straps.
Figure 13:
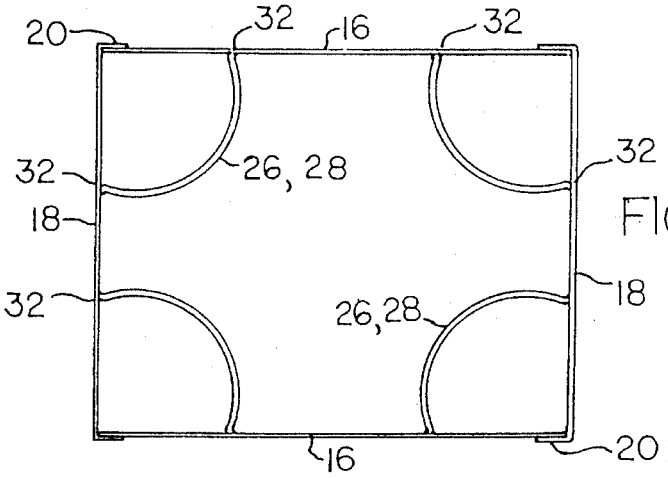
FIG. 13 is a top plan view of the FIG. 12 box structure.

FIGS. 12 and 13 show the box equipped with four upper straps 26 in the box corners, and four lower straps 28 directly below straps 26. These straps are formed by horizontal slits cut into the box end walls and side walls at the box corners. As shown in FIG. 12, horizontal slits 30 in corner areas of the box define straps 26; horizontal slits 31 in corner areas of the box define straps 28.

The individual straps 26 and 28 are anchored to walls 16 and 18 by fixed anchorages 32 spaced equidistant from the associated box corner, whereby the individual strap can be retracted to a position coplanar with walls 16 and 16, or extended away from the box corner to form a loop structure, as shown in FIG. 13. The extended (looped) straps are adapted to partially encircle a conventional beverage cup positioned in the corner of the box structure, whereby the cup is stabilized or restrained against sliding or tipping. Straps 26 and 28 are spaced apart to engage spaced areas on the cup surface, to enhance the cup restraining function.

Each strap 26 or 28 can be retracted into the planes of walls 16 and 18 when there is no need for the cup restraining function, i.e., when there is no beverage cup in the box. With straps 26 and 28 in the retracted positions, the box structure can be folded into a relatively flat configuration suitable for storage.

The box folding operation involves folding side walls 16 downwardly around crease lines 10 onto bottom wall 14, and the simultaneous folding of walls 18 around crease lines 22 so that the triangular portions 19 of walls 18 lie against the central portions of walls 18. The folded box has a flat configuration, wherein walls 18 are folded inwardly to positions between wall 14 and the folded walls 16. The vertical thickness of the folded box is relatively small, about three times the thickness of the cardboard material. The box can be restored to its operating three dimensional configuration by pulling the walls 16 and 18 upwardly around crease lines 10 and 12. When the box is in its operating three dimensional configuration, the straps 26 and 28 can be pulled away from walls 16 and 18 to form cup-restraining loops, as shown in FIG. 13.

Figure 3:
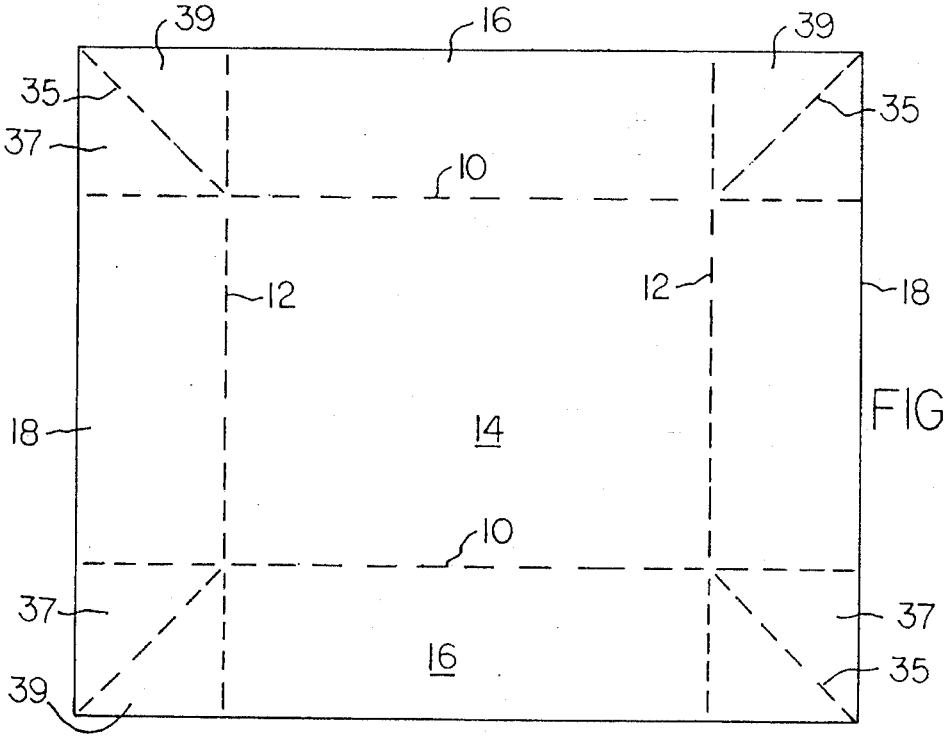
FIG. 3 is a plan view of a cardboard blank used to form the box shown in FIG. 1.

FIGS. 1 through 5 show another form of the invention. The box structure is generally similar to that shown in FIGS. 10 through 13, except for the mechanism used to join the box end walls 18 to the box side walls 16. As shown in FIG. 3, the cardboard blank includes four square sections at the box corners; each square section has a diagonal crease line 35 that forms two triangular zones 37 and 39.

Figure 4:
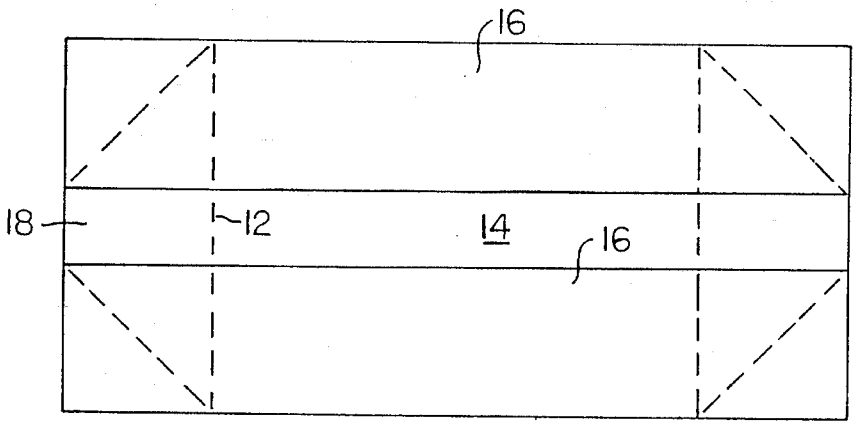
FIG. 4 is a view taken in the same direction as FIG. 3, but showing the cardboard blank folded during the box assembly process.

The FIG. 3 cardboard blank is folded on crease lines 10 so that side walls 16 lie against bottom wall 14, as shown in FIG. 4. Also, each triangular section 37 is glued to the associated end wall 18.

Figure 5:
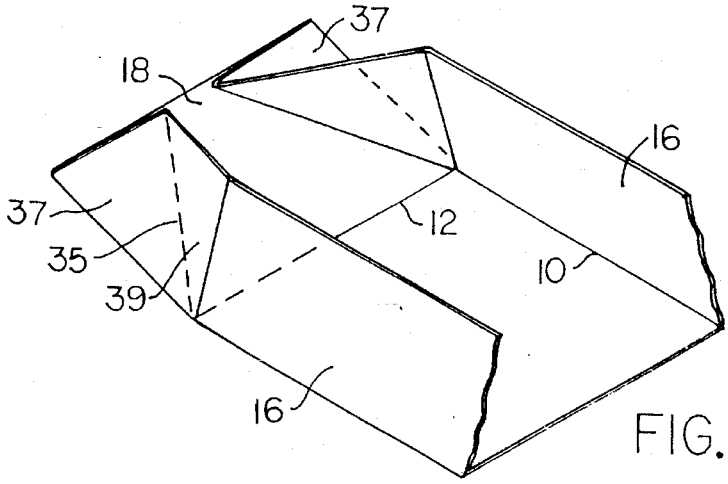
FIG. 5 is a fragmentary perspective view of the FIG. 3 cardboard blank at a further stage in the box assembly process.

FIG. 5 shows the FIG. 4 construction partially unfolded to form the three dimensional box structure. The facing surfaces of the triangular zones 37 and 39 are coated with contact cement so that when end walls 18 are swung upwardly to upright conditions (normal to bottom wall 14) triangular zones 37 and 39 are adhered together on the inner surfaces of end walls 18.

FIGS. 1, 2 and 6 show the box in its upright three dimensional condition. FIG. 4 shows the box in its flat storage condition.

The box shown in FIGS. 1,2 and 6 is equipped with upper and lower cup-retention straps (similar to the straps shown in FIGS. 12 and 13). For illustration purposes, the straps are omitted from FIGS. 3 through 5.

Figure 8:
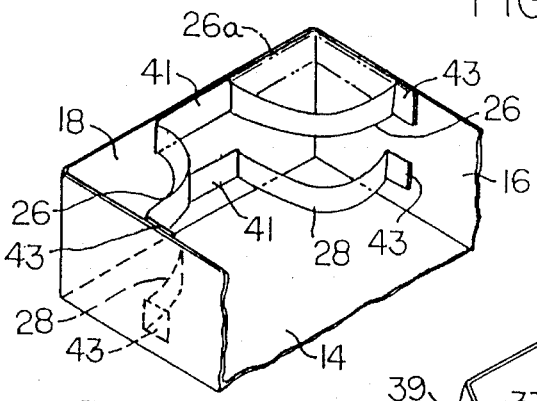
FIG. 8 is a fragmentary perspective view of the assembled box, with the cup-holding straps extended to form cup-encircling loops.

FIG. 8 is a fragmentary perspective view of the FIG. 1 box, showing upper and lower straps 26 and 28 in their extended (loop-forming) positions. The straps are formed out of cardboard strips, separate from the box side walls and end walls. The cardboard strips are anchored to the box side walls and end walls is by gluing the strips to the box walls at zones 41 and 43. Each cardboard strip forms two loops that straddle two box corners; each cardboard strip has one central glued anchorage 41 on the box end wall, and two end glued anchorage 43 on the box side walls.

Each cardboard strap 26 and 28 can be pulled away from the box corner to the loop configuration of FIG. 8; each strap can be pushed back against the box side wall and end wall, as shown, e.g. in dashed lines **26*a* in FIG. 8. FIG. 2 shows three of the four straps 26 in the extended condition, and the fourth strap 26** in the retracted condition.

The anchorage points for the lower straps 28 can be located closer to the associated box corners than the anchorage points for the upper straps, whereby the straps are enabled to fit downwardly tapered beverage cups. FIG. 1 shows two tapered beverage cups 45 and 47 of different diameter restrained by the different straps 26 and 28. Cup 45 is a large cup; cup 47 is a smaller beverage cup. By selecting the anchorage points for the cardboard strips, the resulting straps 26 and 28 can form differently sized loops, for fitting differently sized beverage cups. The anchorage points for the lower straps 28 are closer to the box corners than the upper straps, to adapt the straps to downwardly tapered cup structures. Each strap can be retracted to a folded position, lying against the box end wall 18 and box side wall, as shown at **26*a* in FIG. 8, and in the lower left corner of the box in FIG. 2**.

The foldable box can be used without a carrying handle, as shown in FIGS. 12 and 13. However, in preferred practice of the invention, the box is equipped with a foldable carrying handle 50, as shown in FIGS. 1,2,6 and 7. The illustrated carrying handle 50 is formed out of a cardboard strip, that forms a web-portion 49 adapted to overlie the container (box) body, and two arm portions 51 extending downwardly to connect with the box (container) side walls 16. Lower sections of arm portions 51 are glued to side walls 16. The joints between web portion 49 and arm portions 51 have creases 53; additional creases 55 are formed in the cardboard strip where the arm portions 51 cross the upper edges of side walls 16. Creases 53 and 55 may be formed as shown in FIG. 9. The length of the cardboard strip between creases 53 and 55 is selected to be the same as the height of each box side wall 16. With this dimensional relationship, the carrying handle can be folded into the box so that web portion 49 lies against bottom wall 14, and arm portion 51 lie against the inner surfaces of side walls 16. Crease (fold) lines 53 and 55 promote the desired folding action. The carrying handle is foldable around crease lines 53 and 55 so that the handle 50 is essentially coplanar with box walls 14 and 16, whereby the box can be folded to the FIG. 4 storage condition without interference by the handle. The handle is not shown in FIG. 4 in order to avoid complicating the drawing. FIG. 4 is intended to illustrate the folding action used to fabricate (assemble) the box.

Figure 7:
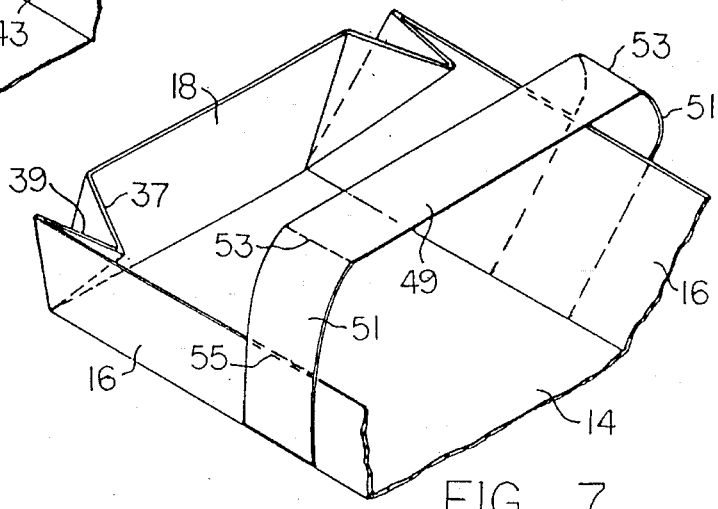
FIG. 7 is a fragmentary perspective view, taken in the same direction ass FIG. 5, but showing a different folding procedure that can be used to assemble the box.

FIG. 5 shows the box cardboard blank folded so that triangular zones 37 and 39 lie against box end walls 18 when the box is in its three dimensional operating condition. FIG. 7 shows the same cardboard blank folded so that triangular zones 37 and 39 extended along side walls 16 when the box is in its three dimensional operating condition. Either arrangement can be used in practice of the invention.

The invention is particularly concerned with the retractible cup retention straps 26 and 28, and the foldable handle 50. The straps and handle are designed to achieve their desired functions without adversely affecting the box folding (or unfolding action). Straps 26 and 28 can be integral with the box walls 16 and 18, as shown in FIGS. 12 and 13. Alternatively, the straps can be formed out of separate cardboard strips, as shown in FIGS. 1,2,6 and 8.

The box folding action can be accomplished in different ways. FIG. 10 shows one folding method. FIGS. 5 and 7 show other folding procedures and structures that can be employed.

It will be appreciated that some variation in structure and arrangement can be employed, while still practicing the invention.

What is claimed is:

1. A box for containing carry-out food, comprising, a container body formed out of cardboard, said container body comprising a bottom wall, two end walls, and two longitudinal side walls, first and second longitudinal crease lines connecting said bottom wall to said side walls; third and fourth transverse crease lines connecting said bottom wall to said end walls, whereby said side walls and said end walls can be folded onto said bottom wall for flat storage or unfolded to upright operating positions;

said end walls and said side walls being connected together to form four upright corners for the container body;

four lower straps joined to said end walls and said side walls adjacent the upright corners of the container body;

four upper straps joined to said end walls and said side walls adjacent the upright corners of the container body; each strap having two anchorages spaced equidistant from an adjacent corner of the container body, whereby each strap can be retracted to a position approximately coplanar with the respective end wall and side wall, or extended from the respective corner to form a loop structure adapted to partially encircle a drinking vessel positioned at said respective corner of the container body;

said straps being affixed to said end walls and said side-walls so that said lower strap anchorages are closer to the respective corners of the container body than said upper strap anchorages, whereby said straps are enabled to fit downwardly tapered drinking vessels.

2. A box for containing carry-out food, comprising;

a container body formed out of cardboard, said container body comprising a bottom wall, two end walls having upper edges and two longitudinal side walls having upper edges; first and second longitudinal crease lines connecting said bottom wall to said side walls; third and fourth transverse crease lines connecting said bottom wall to said end walls, whereby said side walls and said end walls can be folded onto said bottom wall for flat storage or unfolded to upright operating positions wherein said upper edges are spaced from said bottom wall;

said end walls and said side walls being connected together to form four upright corners for the container body;

four straps joined to said end walls and said side walls adjacent the upright corners of the container body;

each strap having two anchorages spaced equidistant from an adjacent corner of the container body, whereby each strap can be retracted to a position approximately coplanar with the respective end wall and side wall, or extended from the respective corner to form a loop structure adapted to partially encircle a drinking vessel positioned at said respective corner of the container body; and a carrying handle for the container body; said handle being formed out of a cardboard strip; said cardboard strip comprising a web portion adapted to overlie the container body, and two attachment arm portions extending between said web portion and the side walls of the container body; first fold lines at the connection points between said web portion and said arm portions; and second fold lines in said arm portions at said upper edges of the container body side walls; whereby said carrying handle is foldable into the container body so that said web portion extends along said side walls of the container body.

* * * * *